United States Patent [19]

Micheli et al.

[11] Patent Number: 5,057,148

[45] Date of Patent: Oct. 15, 1991

[54] METHOD OF DECALCIFYING RARE EARTH METALS FORMED BY THE REDUCTION-DIFFUSION PROCESS

[75] Inventors: Adolph L. Micheli; Dennis F. Dungan, both of Mt. Clemens, Mich.

[73] Assignee: General Motors Corporation, Detroit, Mich.

[21] Appl. No.: 565,080

[22] Filed: Aug. 9, 1990

[51] Int. Cl.[5] ..... B22F 1/00

[52] U.S. Cl. ..... 75/351

[58] Field of Search ..... 75/351, 350, 364; 148/301, 302; 420/85, 121

[56] References Cited

U.S. PATENT DOCUMENTS

| | | | |
|---|---|---|---|
| 3,625,779 | 12/1971 | Cech | 148/101 |
| 3,748,193 | 7/1973 | Cech | 148/101 |
| 3,912,554 | 10/1975 | Arendt et al. | 148/105 |
| 4,917,724 | 4/1990 | Sharma | 75/350 |

OTHER PUBLICATIONS

U.S. patent application Ser. No. 07/256,011 filed Oct. 11, 1988 (abandoned).

*Primary Examiner*—Peter D. Rosenberg
*Attorney, Agent, or Firm*—Lawrence B. Plant

[57] ABSTRACT

Mixtures of a rare earth and an intermetallic compound comprising the rare earth and a ferromagnetic metal selected from the group consisting of iron and cobalt which are formed by the reduction-diffusion process are decalcified by reacting the product of the reduction-diffusion reaction with neodecanoic acid and dissolving the calcium neodecanoate formed thereby in an organic solvent to remove it from the metallic components of the reaction product.

4 Claims, No Drawings

METHOD OF DECALCIFYING RARE EARTH METALS FORMED BY THE REDUCTION-DIFFUSION PROCESS

TECHNICAL FIELD

The present invention relates generally to a method for producing mixtures of rare earth metals and alloys thereof with iron and cobalt by a calcium reduction-diffusion process, and more specifically to separating calcium and calcium oxide from the reaction-diffusion reaction products with little loss of elemental rare earth from the mixture.

BACKGROUND OF THE INVENTION

Rare earth permanent magnets have found particular utility in many commercial applications, including electric motors, NMR scanners, and the like. The advantage of permanent magnets in these applications is their ability to exhibit high level, constant magnetic fluxes without applying an external magnetic field or electrical current. Early such magnets include samarium-cobalt rare earth intermetallic compounds, such as $SmCO_5$ and $Sm_2CO_{17}$. More recently, iron-neodymium-boron and other rare earth-iron/cobalt-based intermetallics have been investigated due to their superior magnetic properties. Magnets made from some of these rare earth-iron/-cobalt-based intermetallics (e.g., $Nd_2Fe_{14}B_1$) are known to require the presence of some (i.e , about 2–5%) elemental rare earth for optimal properties. Consequently, it is imperative to maintain a higher than stoichiometric level (i.e., for the intermetallic) of the rare earth in the final product.

A known method of making samarium-cobalt and other rare earth-iron/cobalt-based magnetic powders is by the so-called "reduction-diffusion" process wherein rare earth compounds such as rare earth oxides, chlorides or fluorides are reduced with a stoichiometric excess (i.e., about 30% excess) of elemental calcium (initially as calcium or calcium hydride) in the presence of the iron and/or cobalt (or Ca-reducible compounds thereof) and the resulting rare earth diffused into the iron/cobalt at elevated temperatures. Subsequent processing produces a Ca-free metallic powder which is ground into particles small enough (i.e., about 1–5 microns) to contain a preferred magnetic domain. The particles are then aligned in a magnetic field and pressed to form a compact and prevent relative motion of the particles. The compact is then sintered, heat treated and magnetized in the prealigned direction.

In conventional samarium-cobalt reduction-diffusion processes, samarium oxide, calcium and/or calcium hydride and cobalt are heated together to reduce the samarium oxide and diffuse the samarium into the cobalt. The resulting mass of rare earth-intermetallic, calcium oxide and unreacted calcium is hydrated with water to alkalize the Ca/CaO and form calcium hydroxide therefrom. The heavier intermetallic settles out while dissolved and undissolved $Ca(OH)_2$ floating in the supernatant liquid are removed by decantation. Thereafter, the intermetallic is washed with a weak acid (e.g., acetic acid) or an acidic solution of $NH_4Cl$ to remove any residual $Ca(OH)_2$ therefrom.

The aforesaid process for making samarium-cobalt magnetics powders has been proposed for making other rare earth-ferromagnetic metal alloy powders. The $Ca(OH)_2$-removal process used in the samarium-cobalt process, however, has not proved effective to produce rare earth intermetallics which require a second, elemental rare earth phase for optimal magnetics (e.g., $Nd_2Fe_{14}B_1$ and Nd). In this regard, removal of the calcium hydroxide from Nd and $Nd_2Fe_{14}B_1$ mixtures by washing with acetic acid serves only to dissolve the highly reactive elemental rare earth phase and thereby leave the resulting mixture too lean with respect to elemental rare earth content for optimal magnetic properties.

U.S. Patent Sharma No. 4,917,724 issued Apr. 17, 1990, and assigned to the assignee of the present invention, strips the $Ca(OH)_2$ from particle mixtures of a rare earth and its alloys by washing with an ammoniacal alkaline solution containing a reagent which forms a calcium salt which is soluble in alkaline solution. Sharma maintains the pH of the solution above 9.0 to prevent dissolution of elemental Nd when the soluble calcium salts are formed. However, the presence of ammonia is undesirable in a manufacturing plant and requires costly ventilation and air treatment facilities. This disadvantage could be eliminated if an $NH_3$-free system could be devised for stripping the reacted and unreacted calcium from the mixture without appreciably dissolving the elemental rare earth component of the mix. Moreover, economics could be achieved by elimination of the hydration step following the reaction-diffusion step.

Accordingly, it is the primary object of the present invention to provide a substantially $NH_3$-free process for stripping calcium and its reaction products from rare earth reduction-diffusion reaction products having an elemental rare earth component (preferably $Nd+Nd_2Fe_{14}B_1$) without appreciable loss of the rare earth component. It is a further object of the present invention to provide such a process which does not require a hydration step following the reduction-diffusion step to alkalize the Ca/CaO present in the product produced by the reduction-diffusion reaction. These and other objects and advantages of the present invention will become more readily apparent from the detailed description thereof which follows.

SUMMARY OF THE INVENTION

In accordance with the present invention, a reduction-diffusion method is provided for preparing a mixture of a rare earth and an intermetallic compound thereof with iron and/or cobalt (e.g., Nd plus $Nd_2Fe_{14}B_1$) which method initially includes reducing a compound of the rare earth (e.g., $Nd_2O_3$) with excess calcium at an elevated temperature (i.e., above about 900° C. for about 3 hours) in the presence of the iron and/or cobalt and then allowing the rare earth metal to diffuse into the iron/cobalt by raising the temperature over 1100° C. and soaking for at least 3 hours. Preferably a small amount of boron or ferro-boron is also present to obtain stronger magnets. The other metals (e.g., iron, cobalt, ferro-boron, etc.) may be present in the reactor either as elements or as compounds reducible by the calcium and alloyable with the rare earth. A preferred reaction involves the reduction of $Nd_2O_3$ by Ca in the presence of Fe and $Fe_4B_6$ (i.e., at about 900° C.–1200° C.) to yield a mass comprising Ca, CaO and a neodymium-iron-boron mixture comprising 15 atomic percent Nd, eight atomic percent boron and 77 atomic percent iron. This reduction-diffusion reaction is essentially as follows:

$$\frac{15}{2}\,Nd_2O_3 + 72Fe + \frac{4}{30}\,Fe_{40}B_{60} + \frac{45}{2}\,Ca \xrightarrow[\text{vac}]{900\text{–}1200^\circ\,C.} Nd_{15}Fe_{77}B_8 + \frac{45}{2}\,CaO$$

and yields a hard, black, clinker-like porous cake comprising neodymium, Nd-Fe-B intermetallics and calcium principally as CaO. Some CaOH may form upon exposure to the atmosphere. Following reduction, the mass is heated to about 1150° C. for a sufficient period (i.e., about 3 hours) to diffuse the Nd into the Fe and B and form a mixture which consists primarily of the $Nd_2Fe_{14}B$ intermetallic, and small amounts of Nd and the $Nd_2Fe_7B_6$ intermetallic. In accordance with the present invention the mixture is thereafter mixed with neodecanoic acid for a sufficient time to convert the calcium constituents of the mixture to calcium neodecanoate. Insignificant amounts of iron, boron and neodymium neodecanoates also form at this time. Any excess neodecanoic acid is then removed and the residue washed with an organic solvent which selectively dissolves the neodecanoates without degrading the metallic components of the residue. Acceptable organic solvents for this purpose include ketones such as acetone and methyl-ethyl ketone, aldehydes such as propionaldehyde, amines such as 1–2 diamino propane, ethers such as tetrahydrofuran, chlorinated hydrocarbons such as methylene chloride, parafinnic hydrocarbons such as hexane and aromatic solvents such as xylene and toluene. Hexane is particularly effective because of the speed with which it dissolves to calcium neodecanoate. On the other hand, because of its flamahibit a less volatile solvent such as methylene chloride is more commercially practical. Alcohols, too, are effect but work too slowly to be commercially practical. The process may alternatively be practiced by mixing the neodecanoic acid with the solvent (e.g., 50–50 by volume) and reacting the mixture with the cake. In this alternative, much of the calcium neodecanoate goes into solution immediately thereby simplifying the subsequent washing step(s).

While the rare earth composition of greatest interest with this process is neodymium-iron-boron, the method of the present invention may be practiced with other reduction-diffusion processes involving rare earth intermetallics which require the presence of a second phase of elemental rare earth for optimal magnetics. Hence, the process of this invention may be used with (1) rare earth metals selected from the lanthanide series (atomic numbers 57 to 71), the actinide series (atomic numbers 89 to 103), and yttrium (atomic number 39) and (2) intermetallic alloys thereof with iron and/or cobalt. In some cases it may be necessary to provide a slight excess of the rare earth to accommodate the small amount converted to rare earth neodecanoate.

The present process does not interfere with the presence of relatively small amounts of other elements and compounds such as aluminum, silicon, dysprosium, copper, etc., which may be present for a variety of metallurgical reasons, e.g., grain refinement.

A SPECIFIC EXAMPLE 184 grams of neodymium oxide ($Nd_2O_3$), with 92 grams of calcium (as calcium or reactive compounds thereof, e.g., CaH) 215 grams of iron and 27 grams of FeB were heated for six (6) hours in a controlled atmosphere furnace to a temperature of about 1000° C. to reduce the $Nd_2O_3$ to Nd and diffuse it into the iron-boron. A clinkerlike cake was formed having a calcium content of 13.7% by weight. Two batches of the cake material were mixed with concentrated (i.e., 97%) neodecanoic acid. In Batch No. 1, 50 grams of the cake was mixed with 200 ml of neodecanoic acid and heated for 24 hours. The cake disintegrated in the acid leaving a powder comprising principally neodymium, the Nd-Fe-B intermetallic and calcium neodecanoate. The excess neodecanoic acid was removed and the powder washed with toluene. In Batch No. 2, 100 grams of the cake was ball milled with 400 ml of neodecanoic acid to form a fine powder and then heated to 80° C. for 24 hours. The resulting powder was then washed two times with toluene.

Chemical analysis of the residues left after the aforesaid washings showed a calcium content in Batch No. 1 of only 0.15% and in Batch No. 2 of only 0.11%. Chemical analysis of the toluene used to wash the powders revealed how much calcium had been removed and how little Nd, Fe and B had been lost in the process. More specifically, the toluene wash solutions were dried at 120° C. which left a waxy residue. The waxy residue was then decomposed at 500° C. to remove any carboniferous material and the remaining ash analyzed. That analysis showed a calcium content of 29.3%, a neodymium content of 1.0%, an iron content of 0.1% and a boron content of less than 0.003% by weight.

While this invention has been disclosed in terms of a specific embodiment thereof it is not intended to be limited thereto but rather only to the extent set forth hereafter in the claims which follows.

The embodiments of the invention in which an exclusive property or privilege is claimed are defined as follows:

1. A method for preparing a mixture of a rare earth and an intermetallic compound comprising said rare earth and a ferromagnetic metal selected from the group consisting of iron and cobalt comprising the steps of:

a) reducing a compound of said rare earth with calcium in the presence of said ferromagnetic metal at an elevated temperature;

b) heating the product of the reducing step for a time and at an elevated temperature sufficient to diffuse most of said rare earth into said ferromagnetic metal and produce a cake of said mixture containing CaO and unreacted Ca;

c) reacting said cake with neodecanoic acid to form calcium decanoate;

d) dissolving said calcium neodecanoate in and organic solvent;

e) separating said dissolved calcium decanoate and solvent from said mixture.

2. The method according to claim 1 wherein said rare earth comprises neodymium.

3. The method according to claim 2 wherein said cake is reacted with concentrated neodecanoic acid and said calcium decanoate is dissolved in said solvent in a separate washing step.

4. The method according to claim 2 wherein said cake is reacted in a solution of neodecanoic acid and said solvent.

* * * * *